US005494882A

United States Patent [19]

Satake et al.

[11] Patent Number: 5,494,882

[45] Date of Patent: Feb. 27, 1996

[54] THERMAL RECORDING MATERIAL

[75] Inventors: Toshimi Satake; Hideki Hayasaka; Toshiyuki Takano; Tomoaki Nagai; Akio Sekine, all of Tokyo, Japan

[73] Assignee: Nippon Paper Industries Co., Ltd., Tokyo, Japan

[21] Appl. No.: 233,759

[22] Filed: Apr. 26, 1994

[30] Foreign Application Priority Data

Apr. 27, 1993 [JP] Japan ..... 5-100598
Aug. 26, 1993 [JP] Japan ..... 5-211748

[51] Int. Cl.[6] ..... B41M 5/30

[52] U.S. Cl. ..... 503/201; 503/216; 503/217; 503/221

[58] Field of Search ..... 427/150–152; 503/201, 212, 216, 217, 221, 226

[56] References Cited

U.S. PATENT DOCUMENTS 5,260,253 11/1993 Kawakami et al. ..... 503/216

FOREIGN PATENT DOCUMENTS 57-94268 12/1982 Japan ..... 503/216
59-1409 8/1984 Japan ..... 503/216
60-53078 9/1985 Japan ..... 503/217
225079 10/1990 Japan ..... 503/201
3129568 12/1991 Japan ..... 503/209
3168698 12/1991 Japan ..... 503/201
4177107 7/1992 Japan ..... 503/216
3156516 1/1993 Japan ..... 503/216
58-58894 10/1993 Japan ..... 503/216

OTHER PUBLICATIONS

Recent Trends of Reuse of Recording Paper and Reversible Recording Media, Chemical Products R and D Center, Richoh Company Limited, 1993.

*Primary Examiner*—B. Hamilton Hess
*Attorney, Agent, or Firm*—Sherman and Shalloway

[57] ABSTRACT

It is provided with a thermal recording material having a support coated with a coating solution as a color developing layer. The color developing layer has a colorless dye precursor which is normally colorless or light-colored, and a developer which reacts with the dye precursor to cause color development thereof upon heating. The developer is a bisthiourea compound represented by, for example, a formula (A-2):

(A-2)

and the thermal color developing layer contains no sensitizer.

In the thermal recording materials of the present invention, substantially no color is developed at a temperature of 120° C. while color development can be caused in response to heating with a thermal head or a laser beam. The developed color on the material can be erased upon contacting with alcoholic solvents, depending on the thiourea compound contained in the color developing layer. After erasure of the image, the material can be used again for recording with a thermal head or a laser beam.

29 Claims, No Drawings

THERMAL RECORDING MATERIAL

BACKGROUND OF THE INVENTION

The present invention relates to a thermal recording material.

Typical thermal recording materials comprise a support such as a sheet of paper, synthesized paper, film or plastic. The support is coated with a coating solution. The coating solution comprises an electron-donative, colorless dye precursor which is normally colorless or light-colored, and an electron-accepting developer such as phenolic compounds. The dye precursor and the developer are separately ground into fine particles and mixed together, to which a binder, a filler, a sensitizer, a lubricant and other additives are added. In response to heating through a thermal head, a thermal pen, a laser beam or the like, the dye precursor instantaneously reacts with the developer to provide visible recording images. Such thermal recording materials have been applied in a wide range of fields including measuring recorders, printers for computer terminals, facsimile devices, automatic ticket vending machines, bar-code labels, etc. The quality requirement of the consumer for the thermal recording materials has been sophisticated as the recording devices have been diversified and had higher performances. For example, it has been required to (a) offer high-density and clear developed images with a smaller amount of thermal energy to increase recording speed and (b) have good storability involving light resistance, heat resistance, water resistance, oil resistance, and plasticizer resistance.

Thermal papers have more opportunities to be compared with plain papers than before with spreading application of a method of recording data on the plain paper such as an electrophotographic method and an ink-jet recording method. For instance, preservability of the resultant images on a thermal recording material is required to be comparable in quality to those recorded with toner. On the other hand, preservability of non-recorded portions (background portions of the paper) (hereinafter, referred to as background preservability) is required to be as close in quality as plain paper. The background preservability against heat (100° C. or higher) or plasticizers is particularly required.

For the background preservability against heat, JP-A-4-353490 (the term "JP-A" as used herein means Japanese Patent Laid-open, or an "unexamined" published Japanese patent application) discloses a thermal recording material in which background or whiteness and density of recorded portion are not deteriorated under a high temperature environment of around 90° C. More specifically, the background of this thermal recording material has a density of some 0.11, measured by a Macbeth densitometer, after processed in a drier at 95° C. for 5 hours. This result is relatively fair but is not in a satisfactory level. In addition, the conventional recording materials with the phenolic developer are insufficient in the heat resistance, so that it is impossible to laminate a film or the like through heat sealing or thermal laminating on the surface of the material subjected to the thermal recording.

The background preservability can be improved in thermal materials comprising a thiourea compound rather than the phenolic one. The thiourea compound is essentially different in structure from a phenolic compound commonly used as a developer. For example, JP-A-58-211496, JP-A-59-184694, JP-A-60-145884, JP-A-61-211085, JP-A-5-4449, and JP-A-5-185739 disclose thermal recording materials comprising a thiourea compound as the developer which the materials are superior in the background preservability (such as heat resistance, water resistance, and plasticizer resistance) and preservability of recorded images. Of these, thiourea compounds disclosed in JP-A-58-211496, JP-A-59-184694, and JP-A-61-211085 are monourea compounds having only one phenylthiourea structure Ar-NH-C=S-NH. These compounds have no superiority to the phenolic developer in view of the heat resistance, which is a major cause of their unsuccessful use in practical applications.

On the other hand, JP-A-60-145884 discloses diphenylbis-thiourea, diphenyl-p-phenylene-dithiourea, and diphenyl-m-phenylene-dithiourea. The first one has two phenylthiourea structures which are directly linked to each other. The remaining two each has two phenylthiourea structures linked through a phenylene group. These thiourea compounds are, however, used along with a color developing enhancer and are thus disadvantageous in the heat resistance. In addition, these thiourea compounds have some disadvantages in the heat resistance of the recorded and background portions even if they are used alone.

JP-A-5-185739 discloses a thermal recording material in which a bisthiourea compound is used as the developer to provide improved resistance to ethanol and plasticizers. The bisthiourea compound is used, however, along with a sensitizer. Accordingly, it is impossible to achieve the heat resistance at 100° C. or higher.

JP-A-5-4449 discloses that recorded images can be stabilized by means of adding, as a third compound, a bisthiourea compound to the color developing composition comprising a dye precursor and a salicylic acid developer. However, this compound can provide neither the heat resistance at 100° C. or higher nor a "reversible recording" characteristic, which allow repeated cycle of recording and erasing, when being prepared according to a method disclosed in the specification.

The reversible recording is an important factor in the field of current thermal recording. More specifically, tremendous efforts have been made to improve the thermal recording materials and such improvements result in rapid increase in consumption amount of the recording material involving in establishment of networks as well as spread of facsimile and copying machines. This means that increased volume of thermal recording papers has been used, which is responsible for current social problems of refuse disposal. A thermal reversible recording material has thus been of interest that permits recording and erasing repeatedly as an approach to this problem.

For example, JP-A-3-230993, and JP-A-4-366682 disclose thermal reversible recording materials whose state changes reversibly from transparent to opaque due to the given temperature. The recording materials for opaque appearance are, however, inferior in clarity and brightness. In addition, color recording is not available in some of the thermal reversible recording materials.

SUMMARY OF THE INVENTION

An object of the present invention is to provide a thermal recording material having an improved heat resistance.

Another object of the present invention is to provide a reversible recording material whose state changes reversibly.

According to a first aspect of the present invention, it is provided with a thermal recording material comprising a support coated with a coating solution as a color developing layer, wherein the color developing layer comprises a colorless dye precursor which is normally colorless or light-colored, and a developer which reacts with the dye precursor to cause color development thereof upon heating, the developer being a bisthiourea compound represented by one of formulae (A-1) through (A-10):

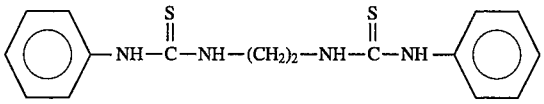

(A-1)

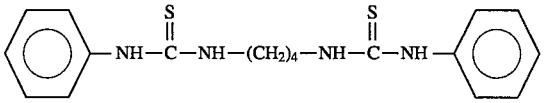

(A-2)

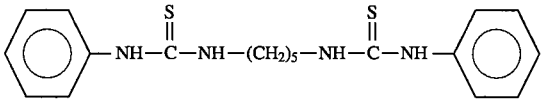

(A-3)

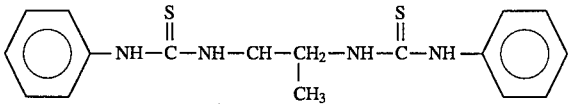

(A-4)

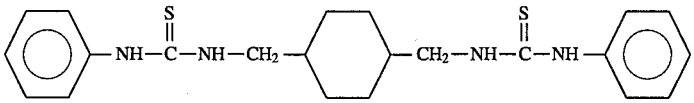

(A-5)

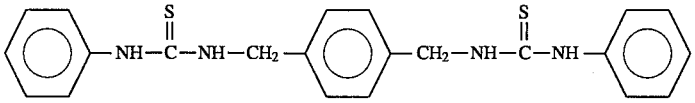

(A-6)

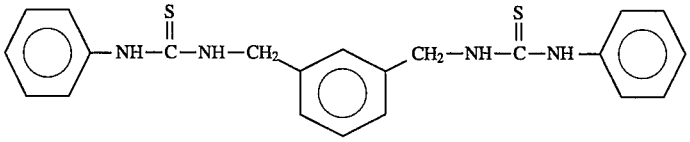

(A-7)

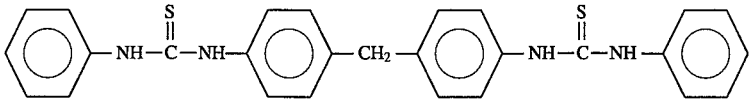

(A-8)

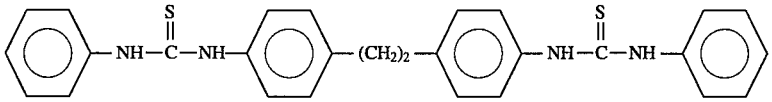

(A-9)

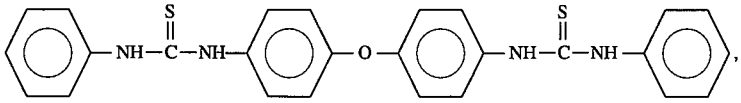

(A-10)

and wherein the thermal color developing layer comprises no sensitizer.

According to a fourth aspect of the present invention, it is provided with a thermal recording material comprising a support coated with a coating solution as a color developing layer, wherein the color developing layer comprises a colorless dye precursor which is normally colorless or light-colored, and a developer which reacts with the dye precursor to cause color development thereof upon heating, the developer being at least one bisthiourea compound represented by the following general formula (I):

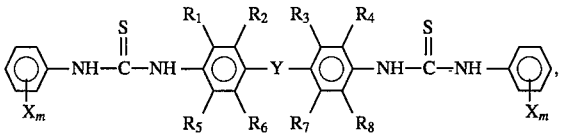

(I)

wherein X, $R_1$, $R_2$, $R_3$, $R_4$, $R_5$, $R_6$, $R_7$, and $R_8$ are each a lower alkyl group having from 1 to 6 carbon atoms, an alkoxy group having from 1 to 6 carbon atoms, a cyclohexyl group, a nitro group, a cyano group, a halogen atom or a hydrogen atom; Y is S or $SO_2$; and m is an integer of from 1 to 3.

According to a second aspect of the present invention, it is provided with a thermal recording material comprising a support coated with a coating solution as a color developing layer, wherein the color developing layer comprises a colorless dye precursor which is normally colorless or light-colored, and a developer which reacts with the dye precursor to cause color development thereof upon heating, the developer being at least one bisthiourea compound represented by the following general formula (II):

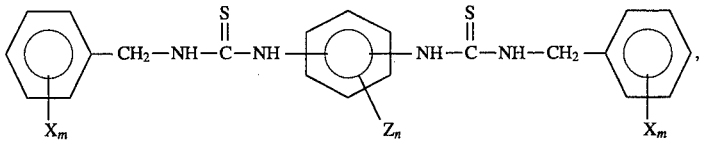

(II)

wherein X and Z are each a lower alkyl group having from 1 to 6 carbon atoms, an alkoxy group having from 1 to 6 carbon atoms, a cyclohexyl group, a nitro group, a cyano group, a halogen atom or a hydrogen atom; and m and n are each an integer of from 1 to 3.

According to a third aspect of the present invention, it is provided with a thermal reversible recording material comprising a support coated with a coating solution as a color developing layer, wherein the color developing layer comprises a colorless dye precursor which is normally colorless or light-colored, and a developer which reacts with the dye precursor to cause color development thereof upon heating and thereby to provide a recorded portion on the material, the developer being a bisthiourea compound represented by one of formulae (A-1), (A-2), (A-4) and (A-10):

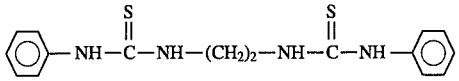

(A-1)

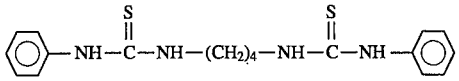

(A-2)

-continued

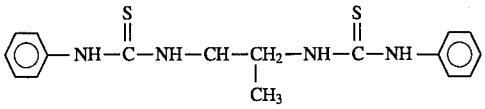

(A-4)

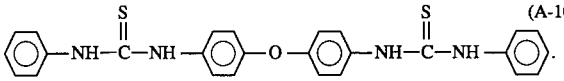

(A-10)

The recorded portion is erased with an alcoholic solvent without affecting preservability and stability of a background.

DETAILED DESCRIPTION OF THE INVENTION

The above mentioned objects can be achieved with a thermal recording material comprising a support coated with a coating solution as a color developing layer, wherein the color developing layer comprises a colorless dye precursor which is normally colorless or light-colored, and a developer which reacts with the dye precursor to cause color development thereof upon heating, the developer being a bisthiourea compound represented by one of formulae (A-1) through (A-10):

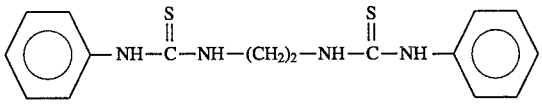

(A-1)

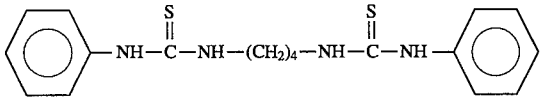

(A-2)

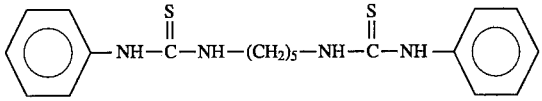

(A-3)

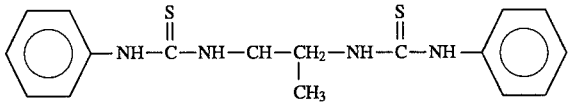

(A-4)

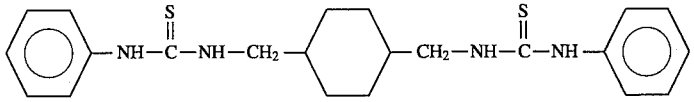

(A-5)

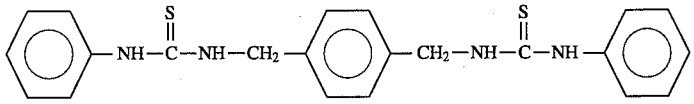

(A-6)

-continued

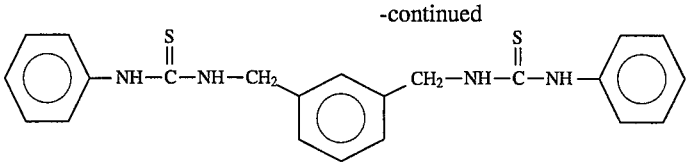

(A-7)

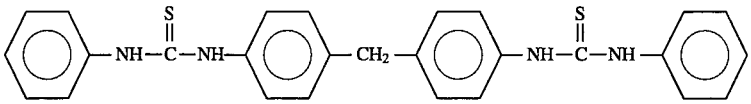

(A-8)

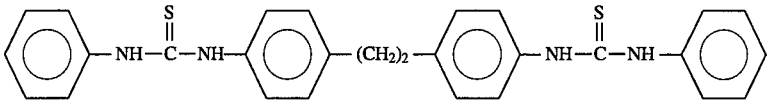

(A-9)

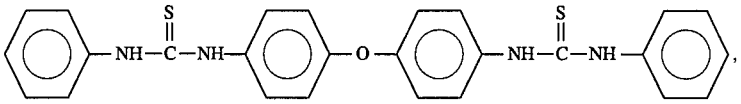

(A-10)

and wherein the thermal color developing layer comprises no sensitizer.

The present invention uses no sensitizer, which contributes to preparation of a thermal recording material having an improved heat resistance. In conventional thermal recording materials, sensitizers as disclosed in JP-A-58-57989, JP-A-58-87094, and JP-A-63-39375 or the like are used to enhance the thermal response or reactivity because the higher thermal response results in improvement of compatibility of the color developer with the dye precursor. However, the sensitizers may melt at a temperature in drying, causing reaction between the dye precursor and the developer and hence developing the background color.

The thermal recording material according to the present invention is excellent in the heat resistance. This means that the thermal recording material can be subjected to heat sealing or thermal laminating after an image is recorded thereon. The developer used in the present invention is a conventional bisthiourea compound selected by means of producing thermal recording materials and performing tests on thermal laminating and heat resistance with heat rolls.

PRODUCTION OF THERMAL RECORDING MATERIALS

Thermal recording materials were produced with bisthiourea compounds used as the developers and 3-N,N-diethylamino- 6-methyl-7-anilinofluoran (ODB) used as the dye precursor. The formulation was as follows:

DISPERSION OF DEVELOPER

| | |
|---|---|
| Bisthiourea Compound | 6.0 parts by weight |
| 10%-polyvinyl Alcohol | 18.8 parts by weight |
| Water | 11.2 parts by weight |

DISPERSION OF DYE PRECURSOR

| | |
|---|---|
| ODB | 2.0 parts by weight |
| 10%-polyvinyl Alcohol | 4.6 parts by weight |
| Water | 2.6 parts by weight |

36.0 parts by weight of the developer dispersion, 9.2 parts by weight of the dye precursor dispersion and 12.0 parts by weight of 50%-dispersion of kaolin clay were mixed into a coating solution. This solution was coated on one surface of a paper support of 50 g/m$^2$ in a coating amount of 6.0 g/m$^2$, which was then subjected to super-calendering to produce a thermal recording material with a smoothness of 500–600 seconds.

THERMAL LAMINATING TEST

The thermal recording materials so produced were subjected to thermal printing with a word processor to cause color development, following which the materials were subjected to thermal laminating with a simple laminating machine. Subsequently, color-developed and background portions of the materials were measured with a Macbeth densitometer.

HEAT RESISTANCE TEST

The thermal recording materials so produced were forced to a hot plate, which had previously heated to 200° C., at a pressure of 10 g/cm$^2$ for 5 seconds to cause color development. The color-developed thermal recording materials were passed between heat rolls of 160° C. at a speed of 30 mm/s. Subsequently, color-developed and background portions of the materials were measured with a Macbeth densitometer.

As a result, it was found that the bisthiourea compounds A-2, A-4, A-7 and A-8 are capable of providing a well-balanced thermal recording material in view of the preservability of the recorded image and the thermal stability.

The thermal recording materials according to the present invention, which comprise any one of the above mentioned thiourea compounds as the developer and comprise no sensitizer, can develop the color with an instantaneous high thermal energy applied through a thermal head. However, the materials remain stable without causing color development of the background when being exposed to a hot environment of 100° C. or higher. This makes it possible to use the thermal recording materials according to the present invention for heat sealing to laminate a film on the recorded surface, which cannot be achieved with conventional thermal recording materials. In addition, it is also possible to use the thermal recording material according to the present invention for plain paper copying (PPC), on which toner is transferred and fixed thermally.

Another form of a thermal recording material according to the present invention comprises a support coated with a coating solution as a color developing layer, wherein the color developing layer comprises a colorless dye precursor which is normally colorless or light-colored, and a developer which reacts with the dye precursor to cause color development thereof upon heating, the developer being at least one bisthiourea compound represented by the following general formula (I):

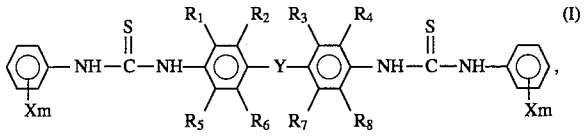

(I)

wherein X, $R_1$, $R_2$, $R_3$, $R_4$, $R_5$, $R_6$, $R_7$, and $R_8$ are each a lower alkyl group having from 1 to 6 carbon atoms, an alkoxy group having from 1 to 6 carbon atoms, a cyclohexyl group, a nitro group, a cyano group, a halogen atom or a hydrogen atom; Y is S or $SO_2$; and m is an integer of from 1 to 3.

Specific examples of the bisthiourea compound represented by the general formula (I) include following compounds.

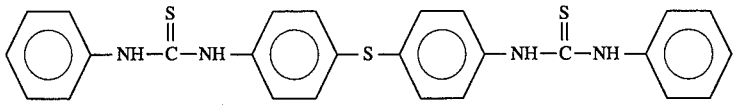

(B-1)

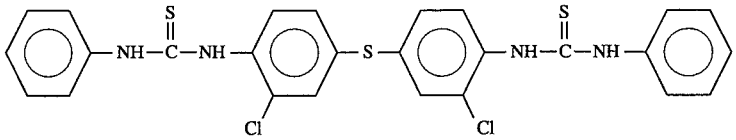

(B-2)

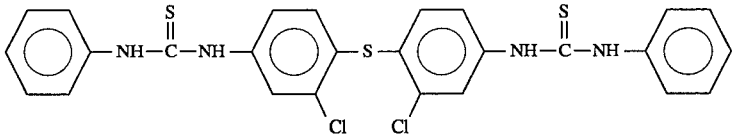

(B-3)

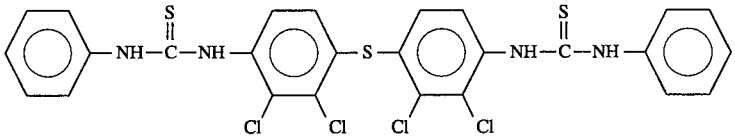

(B-4)

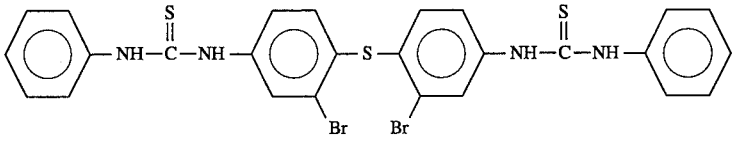

(B-5)

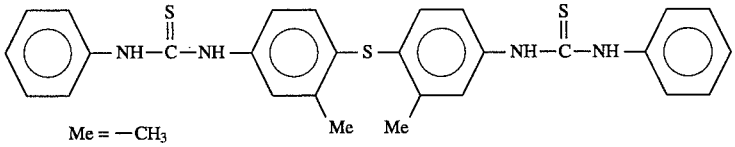

(B-6)

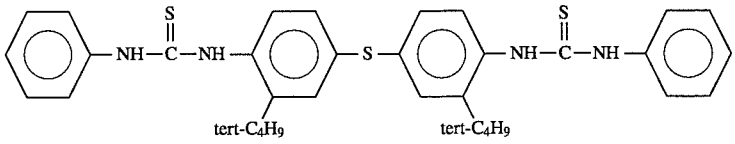

(B-7)

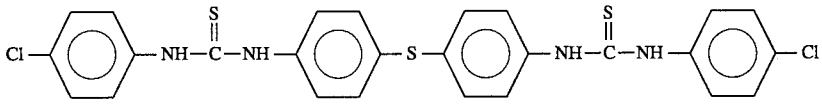

(B-8)

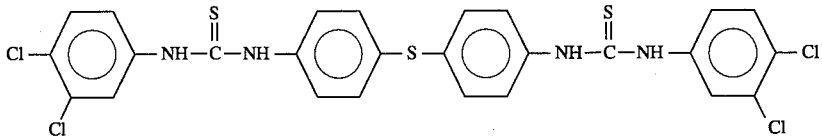

(B-9)

-continued
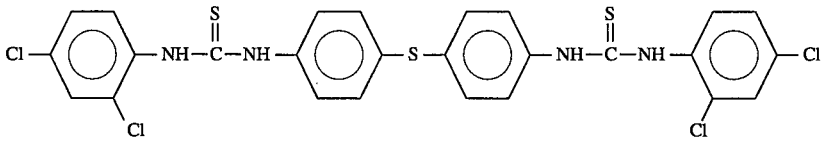
(B-10)
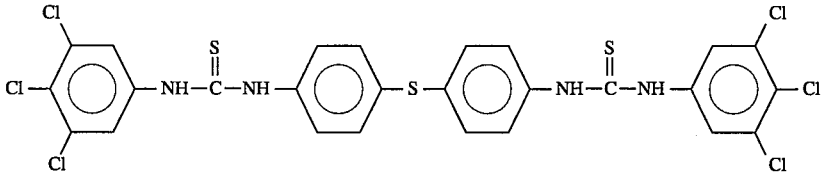
(B-11)
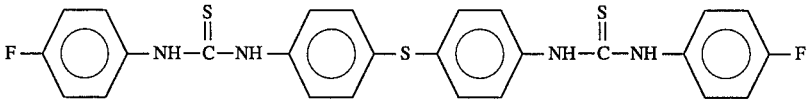
(B-12)
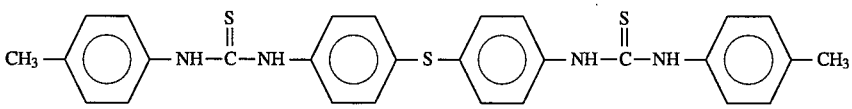
(B-13)
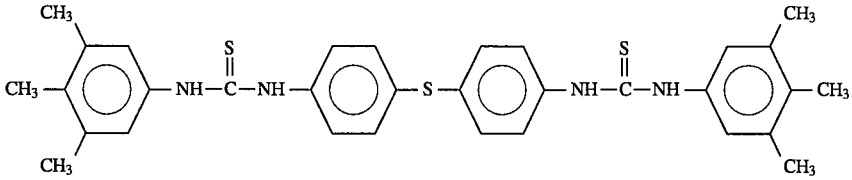
(B-14)
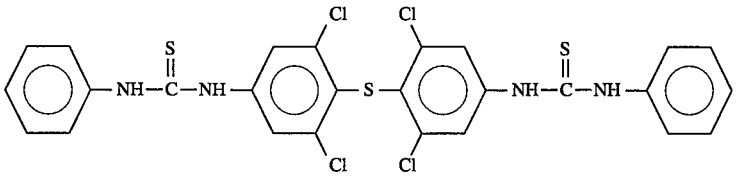
(B-15)
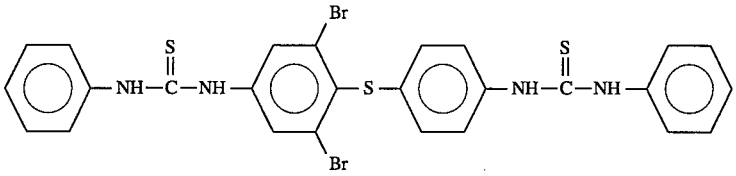
(B-16)
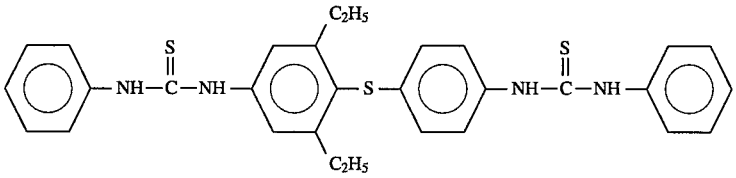
(B-17)
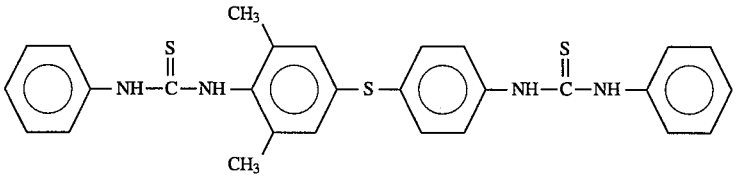
(B-18)
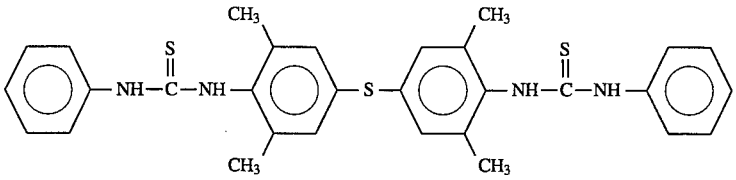
(B-19)

-continued (B-20)

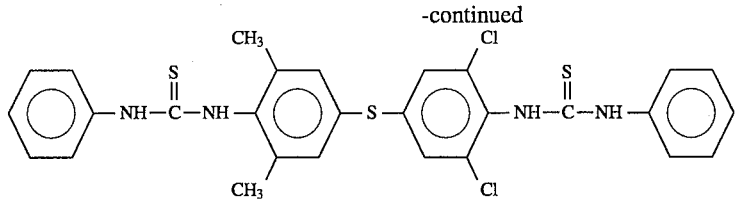

(B-21)

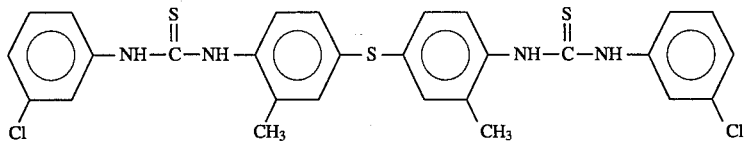

(C-1)

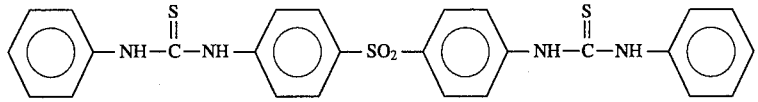

(C-2)

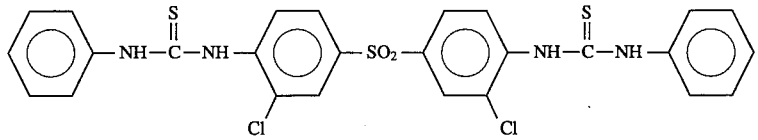

(C-3)

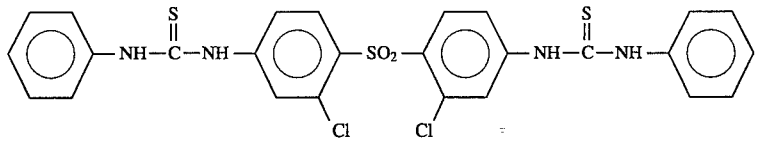

(C-4)

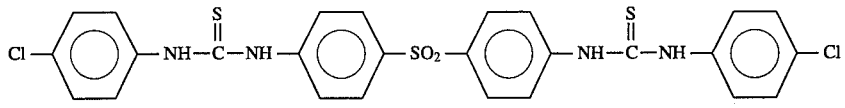

(C-5)

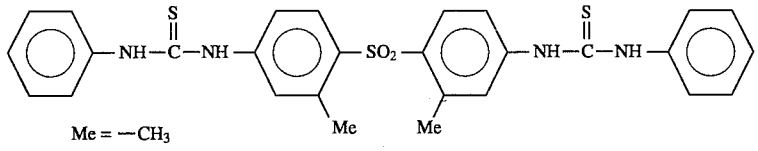

(C-6)

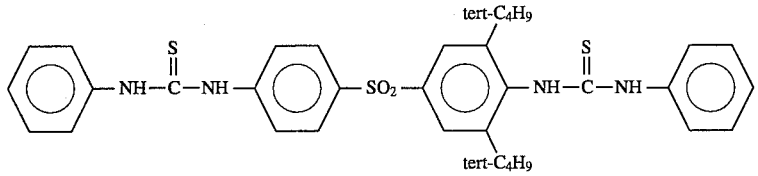

(C-7)

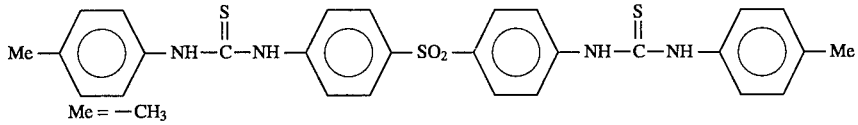

The thermal recording materials comprising the bisthiourea compound represented by the general formula (I) exhibited excellent heat resistance in the above mentioned heat resistance test.

In the present invention, it is also provided with a thermal recording material comprising a support coated with a coating solution as a color developing layer, wherein the color developing layer comprises a colorless dye precursor which is normally colorless or light-colored, and a developer which reacts with the dye precursor to cause color development thereof upon heating, the developer being at least one bisthiourea compound represented by the following general formula (II):

(II)

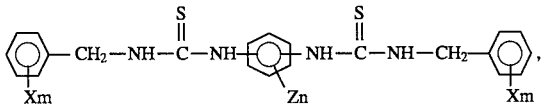

wherein X and Z are each a lower alkyl group having from 1 to 6 carbon atoms, an alkoxy group having from 1 to 6 carbon atoms, a cyclohexyl group, a nitro group, a cyano group, a halogen atom or a hydrogen atom; and m and n are each an integer of from 1 to 3.

The bisthiourea compound represented by the general formula (II) is expected to have two benzylthiourea structures linked through a phenylene group. Specific examples of the bisthiourea compound represented by the general formula (II) include following compounds.

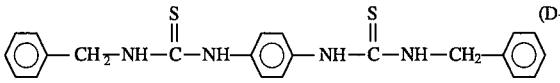
(D-1)

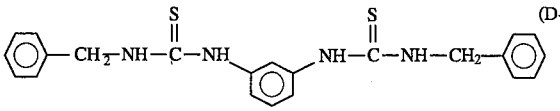
(D-2)

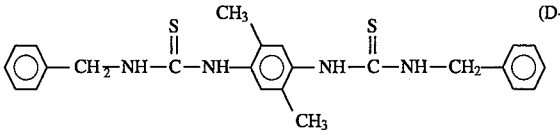
(D-3)

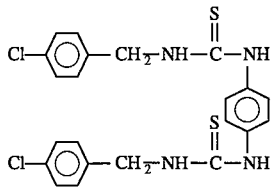
(D-4)

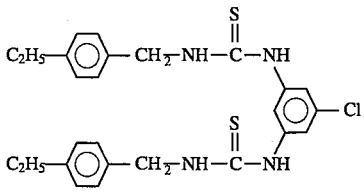
(D-5)

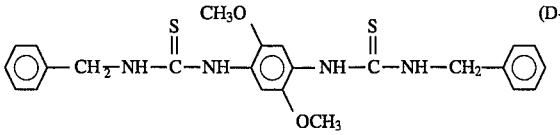
(D-6)

The thermal recording materials comprising the bisthiourea compound represented by the general formula (II) are also excellent in the preservability of the background. The materials can be used for thermal laminating and toner recording. In addition, the thermal recording material comprising the compound D-1 exhibited good reversible recordability (erasure of recorded images on the surface with an alcoholic solvent and recording on the same surface). Such thermal reversible recording material can be obtained in another form of the present invention in which a thermal reversible recording material comprising a support coated with a coating solution as a color developing layer, wherein the color developing layer comprises a colorless dye precursor which is normally colorless or light-colored, and a developer which reacts with the dye precursor to cause color development thereof upon heating and thereby to provide a recorded portion on the material, the developer being a bisthiourea compound represented by one of formulae (A-1), (A-2), (A-4) and (A-10):

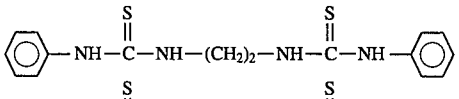
(A-1)

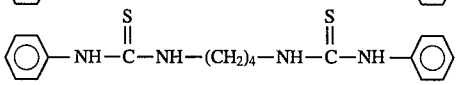
(A-2)

-continued

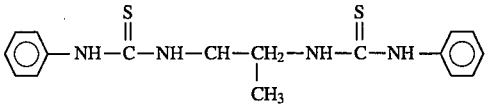
(A-4)

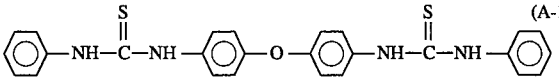
(A-10)

The "thermal recording material having the reversible recordability" is the one whose state changes reversibly. More specifically, recorded portion on the surface of the material can be erased by means of contacting the surface with an alcoholic solvent. The resultant material can be used for re-recording other images with a thermal head or a laser beam. Exemplified alcoholic solvents are: methanol, ethanol, n-propylalcohol, iso-propylalcohol, n-butanol, sec-butanol, and tert-butanol. It is apparent that the background should be stable during erasing with the alcoholic solvent. Alternatively, recorded images on the thermal recording material comprising a specific developer may be erased by means of transferring a certain level of a thermal energy to the surface of the material with, for example, heat rolls, thermal-head, drying oven. After erasing, the thermal recording material can be recycled for another recording. For example, the thermal recording material comprising the compound A-1 exhibited good erasability when being passed between heat rolls.

The idea of the present invention to change the state of the thermal recording material reversibly is quite the opposite to the viewpoint of ethanol resistance disclosed in JP-A-5-185739. More specifically, this conventional thermal recording material comprises 2-anilino-3-methyl-6-(N-ethyl-N-tetrahydrofurfurylamino)fluoran as the dye, a bisthiourea compound as the developer, and di(p-methylbenzyl) oxalate as the sensitizer. JP-A-5-185739 discloses resistance to ethanol and plasticizers. On the contrary, in the present invention, the bisthiourea compounds are selected according to erasability or discoloration of the recorded portion with ethanol.

The thermal recording materials whose state changes reversibly are preferable to be capable of providing low preservability for the recorded portion and high preservability for the background. To achieve this feature, a sensitizer may advantageously be used. As mentioned above, sensitizers badly affect the heat resistance but are favorable in reversible recording. Preferred examples of the sensitizer applicable for this purpose include: 2-di(3-methylphenoxy-)ethane, p-benzylbiphenyl, β-benzyloxynaphtalene, 4-biphenyl-p-tolylether, m-terphenyl,1,2-diphenoxyethane, dibenzyl oxalate, and di(p-chlorobenzyl) oxalate.

The thermal recording material according to the present invention, which comprises the bisthiourea compound and which is excellent in the heat resistance, has a "conflicting" feature that substantially no color is developed at a temperature of 120° C. while color development can be caused with a thermal head or the like. The developed color on the thermal recording material of the present invention will not be erased or discolored when the material contacts with organic solvents other than alcoholic ones. Likewise, the background is not changed in color upon contacting with the organic solvents other than alcoholic ones. This may be because the bisthiourea compounds applicable to the present invention have low solubility to such organic solvents. The thermal recording materials having excellent heat resistance according to the present invention have another advantage of easy management of manufacturing process. Typical methods of manufacturing thermal recording materials include a process of drying a thermal color developing layer after a coating solution is applied on the surface of a support. Conventional drying process should be made under strict temperature control to avoid color development of the background on the coated surface. This restricts an available range of coating speed. On the contrary, in the thermal recording material according to the present invention, no color is developed on the background when the material is exposed to hot air of 110° C. in a dried environment. This permits the drying process at a high temperature. In addition, a controlled range of the drying temperature can be increased with a probable rapid increase of productivity.

As mentioned above, in the thermal reversible recording material comprising a bisthiourea compound according to the present invention, the recorded portion on the surface of the material can be erased by means of contacting the surface with an alcoholic solvent. Alternatively, the images may be erased by means of transferring a certain level of a thermal energy to the surface of the material with, for example, heat rolls or the like in an adequate thermal condition, depending on the compound contained in the color developing layer. After erasing, the material can be used for re-recording of other images with a thermal head or a laser beam.

The thermal recording materials according to the present invention are manufactured through any one of conventional methods of preparing a coating solution, coating the solution on a support, and drying the solution. The coating solution may be prepared by means of dispersing (a) a dye precursor, and (b) a bisthiourea compound, which serves as a developer, according to the present invention, separately with a binder. The coating solution may further contain one or more additives such as fillers, lubricants, ultraviolet ray absorbers, water-proof agents, and anti-foaming agents.

The dye precursor used in the thermal recording material according to the present invention is not limited to a specific one and may be any one of conventional dye precursors known in the field of thermal recording. However, it is preferable to use a triphenylmethane-, fluoran-, or fluoren-based dye. Preferable examples of the dye precursor are given below.

<Triphenylmethane Leuco Dyes>

Crystal Violet Lactone (CVL), and

Malachite Green Lactone (MGL)

<Fluoran Leuco Dyes>

3-diethylamino-6-methyl-7-anilinofluoran, 3-diethylamino-6-methyl-7-(o,p-dimethylanilino)fluoran, 3-diethylamino-6-methyl-7-(m-trifluoromethylanilino)fluoran, 3-diethylamino-6-methyl-7-(o-chloroanilino)fluoran, 3-diethylamino-6-methyl-chlorofluoran, 3-diethylamino-6-methyl-fluoran, 3-diethylamino-6-chloro-7-anilinofluoran, 3-diethylamino-6-ethoxyethyl-7-anilinofluoran, 3-diethylamino-benzo[a]-fluoran, 3-pyrrolidino-6-methyl-7-anilinofluoran, 3-piperidino-6-methyl-7-anilinofluoran, 3-dibutylamino-6-methyl-7-anilinofluoran, 3-dibutylamino-6-methyl-7-(o,p-dimethylanilino)fluoran, 3-dibutylamino-6-methyl-7-(m-trifluoromethylanilino)fluoran, 3-dibutylamino-6-methyl-7-(o-chloroanilino)fluoran, 3-dibutylamino-6-methyl-7-(o-fluoroanilino)fluoran, 3-dibutylamino-6-methyl-chlorofluoran, 3-dibutylamino-6-methyl-fluoran, 3-dibutylamino-6-chloro-7-anilinofluoran, 3-din-pentylamino-6-methyl-7-anilinofluoran, 3-din-pentylamino-6-chloro-7-anilinofluoran, 3-(N-ethyl-N-toluidino)-6-methyl-7-anilinofluoran, 3-(N-ethyl-N-isoamylamino)-6-methyl-7-anilinofluoran, 3-(N-ethyl-N-tetrahydrofurfurylamino)-6-methyl-7-anilinofluoran, 3-(N-ethyl-N-hexylamino-6-methyl-7-(p-chloroanilino)fluoran, 3-(N-cyclohexyl-N-methylamino)-6-methyl-7-anilinofluoran, 3-(N-methyl-N-propylamino)-6-methyl-7-anilinofluoran, 3-cyclohexylamino-6-chlorofluoran, 2-(4-oxahexyl)-3-dimethylamino-6-methyl-7-anilinofluoran, 2-(4-oxahexyl)-3-diethylamino-6-methyl-7-anilinofluoran, and 2-(4-oxahexyl)-3-dipropylamino-6-methyl-7-anilinofluoran <Fluoren Leuco Dyes>

3,6,6'-tris(dimethylamino)spiro[fluoren-9-3'-phthalid], and 3,6,6'-tris(diethylamino)spiro[fluoren-9-3'-phthalid]

These dye precursors may be used alone or may be a mixture of two or more dye precursors. The fluoran dye precursors can be used advantageously in the present invention because the thermal recording material comprising the precursor of this type can provide improved preservability of the background under a high temperature. When the thermal stability or preservability of the background is an important factor, it is preferable to use a dye having a high melting point and a high decomposition temperature. In addition, it is preferable to mix two or more kinds of dye precursors by the consideration of the object of the present invention, i.e., to provide an excellent thermal stability of the background. On the contrary, when a reversible recordability is an important factor, a dye such as 3-diethylamino-7-(m-trifluoromethylanilino)fluoran is particularly preferable.

Examples of the binder applicable to the present invention include: completely silicified polyvinyl alcohol, partially saponified polyvinyl alcohols, carboxy denatured polyvinyl alcohols, amides denatured polyvinyl alcohols, sulfonic acid denatured polyvinyl alcohols, butylal denatured polyvinyl alcohols, other denatured polyvinyl alcohols, which are each 200–1,900 in degree of polymerization (D.P.); cellulose derivatives such as hydroxyethyl cellulose, methyl cellulose, carboxymethyl cellulose, ethyl cellulose and acetyl celluloses, styrene-maleic anhydride copolymers, styrene-butadiene copolymers; polyvinyl chloride, polyvinyl acetate, polyacrylamide, polyester acrylate, polyvinyl butylal, polystyrol, and copolymers thereof; polyamide resins, silicon resins, petroleum resins, terpene resins, ketone resins, and chroman resins. Of these, polyvinyl alcohol binders are preferable by the considerations of dispersability, binding capacities, and thermal stability of the background. These binders may be dissolved in a solvent such as water, alcohols, ketones, esters, and hydrocarbons. Alternatively, the binders may be dispersed in water or other medium as an emulsion or paste. In addition, a combination of dissolution and dispersion may be used depending on the quality being required.

Examples of the filler applicable to the present invention include: inorganic fillers such as silica, calcium carbonate, kaolin, diatomaceous earth, talc, titanium oxide, and aluminum hydroxide; and organic fillers such as organic polystyrene fillers, organic styrene-butadiene fillers, and organic styrene-acryl fillers.

In addition to the above mentioned additives, other compounds may be added such as parting agents like fatty acid metal salts, lubricants like waxes, benzophenone-based or benzotriazole-based ultraviolet ray absorbers, waterproof agents like glyoxal, dispersants, and anti-foaming agents.

There are no limitations on amounts of the bisthiourea compound and the dye precursor blended in a coating solution according to the present invention, the kind of the other components, and the amounts thereof. Instead, they are determined according to the desired performances and recording aptitudes. However, a simple blending is preferable to avoid deterioration of the thermal stability of the background. In a typical example, the coating solution comprises 1 to 8 parts by weight of bisthiourea developer and 1 to 20 parts by weight of filler relative to 1 part of dye precursor. In addition, the coating solution comprises 10% to 25% by weight of binder, based on the total weight of solids.

These compounds are formed into fine particles having a particle diameter of several microns or smaller through a grinder such as a ball mill, an attritor, and a sand grinder or any other emulsifying machines. The binder and other additives, if necessary, are added to the fine particles, which is then prepared into the coating solution. The coating solution having the above mentioned composition is applied to an adequate support to provide a desired thermal recording material. The support may be a sheet of paper or synthetic paper, an unwoven fabric, a metal foil, a plastic film, a plastic sheet, or a combination thereof as a composite sheet.

The thermal recording material so obtained can be provided with an overcoating layer on the thermal color developing layer to improve the preservability or storability. Alternatively, an undercoating layer may be provided under the thermal recording layer to improve color developing sensitivity. The overcoating layer may be a polymer material while the undercoating layer may be a polymer material containing one or more fillers.

In particular, the thermal recording material according to the present invention which is excellent in the heat resistance can be provided with a transparent, strong protecting coating by means of thermal laminating a film on the surface of the material having images recorded thereon using the high thermal stability of the background. In this event, commercially available simple laminating machines may be used to make through a simple manner a card with the thermal-recorded images thereon.

It has not yet been elucidated why the bisthiourea compounds alone can serve as the developers for the dye precursors, why the high heat resistance which is not expected before can be achieved by means of eliminating sensitizers, and why the high reversible recordability can be achieved depending on the compounds. However, a probable reason for these points is that the thiourea compounds according to the present invention are changed in structure from thioketon to enthiol or vise versa as given below:

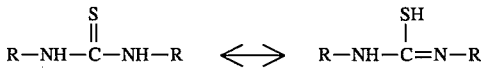

(THIOKETON STRUCTURE) (ENTHIOL STRUCTURE)

It is expected that enthiolation is essential for the bisthiourea compounds to function as the developer. Enthiolation can occur only at a high temperature. With a thermal head, a high temperature of from 200° to 300° C. is achieved instantaneously, so that the bisthiourea compound contacting with the thermal head is enthiolated, which results in color developing capability to break a lactone ring of the dye precursor and hence to develop the color. On the other hand, the bisthiourea compound is not changed at a temperature lower than that causing enthiolation. Accordingly, the bisthiourea compound is not reacted with the dye precursor and the background remains white. This may explain the high heat resistance of the materials according to the present invention. In addition, a good color developing feature cannot be achieved with the monothiourea compounds probably because they have only one active hydrogen. On the contrary, the bisthiourea compounds have the increased number of active hydrogens, which may contribute to achieving the good color developing features.

The thermal recording materials of this invention are also excellent in resistance to solvents. This may be because the bisthiourea compounds have an extremely low solubility to the solvents, and substantially no developer is mixed with the dye precursor upon contacting with the solvents.

Finally, discoloration may occur to provide the reversible recordability when the thermal recording material is changed in structure from enthiol back to thioketon due to a certain reason. This thioketonation may be caused upon contacting with alcoholic solvents, otherwise with adequate temperature and thermal energy. Enthiolation and thioketonation occur under different conditions, so that the thermal recording material can be changed in structure repeatedly between enthiol and thioketon, which permits the reversible recording.

The foregoing features of the present invention will be more readily apparent in the context of a specifically delineated set of examples and controls. However, it should be understood that the present invention is not limited to those particular examples and the reference as long as it does not depart from the spirit and scope of the appended claims.

In the following description, all percents and parts are by weight unless otherwise specified.

EXAMPLES 1–19

Thermal recording materials were produced with bisthiourea compounds used as the developers and 3-N,N-diethylamino- 6-methyl-7-anilinofluoran (ODB) used as the dye precursor. The formulation was as follows.

DISPERSION OF DEVELOPER

| | |
|---|---|
| Bisthiourea Compound (See, Table 1) | 6.0 parts |
| Aqueous Solution of 10%-polyvinyl Alcohol | 18.8 parts |
| Water | 11.2 parts |

DISPERSION OF DYE PRECURSOR

| | |
|---|---|
| ODB | 2.0 parts |
| Aqueous Solution of 10%-Polyvinyl Alcohol | 4.6 parts |
| Water | 2.6 parts. |

Each dispersion of the above mentioned compounds were ground into fine particles having an average particle diameter of 1 micron by using a sand grinder. Subsequently, the dispersions were mixed in a following formulation to prepare a coating solution.

| | |
|---|---|
| Dispersion of Developer | 36.0 parts |
| Dispersion of Dye Precursor | 9.2 parts |
| Kaolin Clay (50% dispersion) | 12.0 parts |

This solution was coated on one surface of a paper support of 50 g/m$^2$ in a coating amount of 6.0 g/m$^2$, which was then subjected to super-calendering to produce a thermal recording material with a smoothness of 500–600 seconds.

CONTROLS 1–17

Thermal recording materials were produced for comparison with following known compounds used as the developer:

bisphenol A (E-1), bisphenol S (E-2), 4-hydroxy-4'-iso-propoxydiphenylsulfon (E-3), 4-hydroxy-4'-n-butoxydiphenylsulfon (E-4), 1,3-diphenylthiourea (E-5) (disclosed in JP-A-58-211496), 1,3-benzylphenylthiourea (E-6), 1,3-phenylstearylthiourea (E-7), 1,3-di(m-chlorophenyl)thiourea (E-8), 1,3-di (p-toluyl)thiourea (E-9) (disclosed in JP-A-58-211496), diphenylbisthiourea (E-10) (disclosed in JP-A-60-145884), bisthiourea compound (E-11) (disclosed in JP-A-5-185739), bisthiourea compound (E-12) (disclosed in JP-A-5-185739), bisthiourea compound (E-13) (disclosed in JP-A-5-185739), diphenyl-p-phenylene-dithiourea (E-14) (disclosed in JP-A- 60-145884), diphenyl-m-phenylene-dithiourea (E-15) (disclosed in JP-A- 60-145884), bisthiourea compound (E-16) (disclosed in JP-A-5-185739), and bisthiourea compound (E-17) (disclosed in JP-A-5-185739).

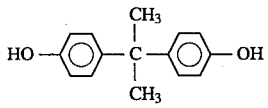
(E-1)

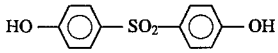
(E-2)

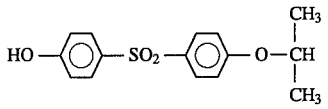
(E-3)

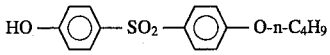
(E-4)

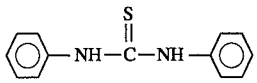
(E-5)

-continued

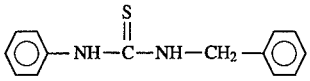
(E-6)

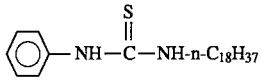
(E-7)

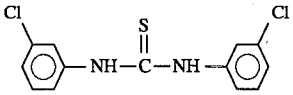
(E-8)

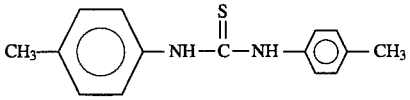
(E-9)

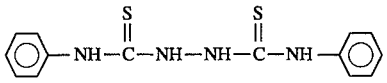
(E-10)

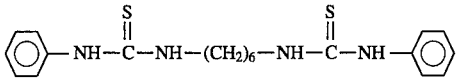
(E-11)

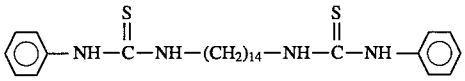
(E-12)

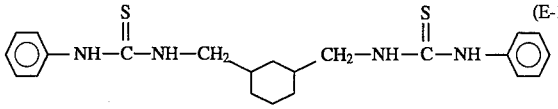
(E-13)

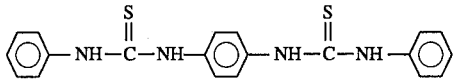
(E-14)

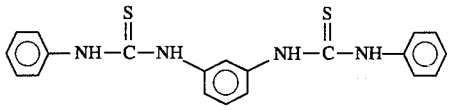
(E-15)

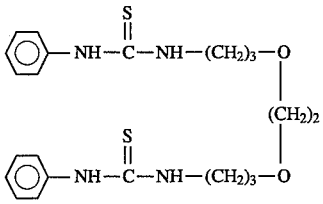
(E-16)

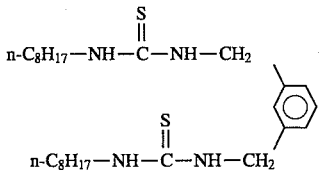
(E-17)

DISPERSION OF DEVELOPER

| | |
|---|---|
| Comparative Compound (E-1 through E-17) (See, Table 2) | 6.0 parts |
| Aqueous Solution of 10%-polyvinyl Alcohol | 18.8 parts |
| Water | 11.2 parts |

DISPERSION OF DYE PRECURSOR

| | |
|---|---|
| ODB | 2.0 parts |
| Aqueous solution of 10%-polyvinyl Alcohol | 4.6 parts |
| Water | 2.6 parts |

Each dispersion of the above mentioned compounds were ground into fine particles having an average particle diameter of 1 micron by using a sand grinder. Subsequently, the dispersions were mixed in a following formulation to prepare a coating solution.

| | |
|---|---|
| Dispersion of Developer with Comparative Compound | 36.0 parts |
| Dispersion of Dye Precursor | 9.2 parts |
| Kaolin Clay (50% dispersion) | 12.0 parts |

Thermal recording materials were produced in the same manner as in Examples 1 through 19.

CONTROLS 18–20

As disclosed in JP-A-5-4449, a zinc salicylate compound was used as the developer, to which the bisthiourea compound was added as a third compound to produce thermal recording materials.

(a) 20 g of 2-anilino-3-methyl-6-N-tetrahydrofurfurylamino)fluoran as the dye precursor, (b) 20 g of 4-p-methoxyphenoxyethoxy zinc salicylate (represented by SA1-Zn in Table 3) as the developer, (c) 20 g of the bisthiourea compound A-8, A-10 or E-10 as the additive, and (d) 20 g of di(p-methylbenzyl) oxalate ester as the sensitizer were each dispersed along with 100 g of 5% polyvinyl alcohol (PVA-150 available from Kuraray Co., Ltd.) aqueous solution by using a ball mill over day and night until an average particle diameter of 1.5 μm or smaller was achieved to prepare the dispersions. In addition, 80 g of calcium carbonate was dispersed along with 160 g of 0.5% solution of sodium hexamethacrylate by using a homogenizer to prepare a pigment dispersion (e). The dispersions prepared in the manner described above were mixed in a following formulation to obtain a thermal coating solution.

| | |
|---|---|
| (a) Dye Precursor Dispersion | 5 parts |
| (b) Developer Dispersion | 10 parts |
| (c) Thiourea Compound Dispersion | 3 parts |
| (d) Sensitizer Dispersion | 10 parts |
| (e) Calcium Carbonate Dispersion | 5 parts |

The thermal coating solution was applied to a wood free paper of 50 g/m$^2$ in basic weight by using a wire bar to provide a dry weight of 5 g/m$^2$ of the coated layer, which was dried at 50° C. for 1 minute to produce thermal recording papers.

CONTROLS 21–23

Controls 18–20 were repeated to produce thermal recording materials except that the 4-p-methoxyphenoxyethoxy zinc salicylate (SA1-Zn) developer was replaced by 3,5-bis(methylbenzyl) zinc salicylate (represented by SA2-Zn in Table 3), and that the compounds A-5, A-7 or E-12 were used as the additive in place of the bisthiourea compounds A-8, A-10 or E-10, respectively.

CONTROLS 24 and 25

As disclosed in JP-A-5-185739, a bisthiourea compound was used as the developer, to which the di(p-methylbenzyl) oxalate ester was added as the sensitizer to produce thermal recording materials.

(a) 20 g of 2-anilino-3-methyl-6-N-tetrahydrofurfurylamino)fluoran as the dye precursor, (b) 20 g of the bisthiourea compound A-5 or A-10 as the developer, and (c) 20 g of di(p-methylbenzyl) oxalate ester as the sensitizer were each dispersed along with 100 g of 5% polyvinyl alcohol (PVA-150 available from Kuraray Co., Ltd.) aqueous solution by using a ball mill over day and night until an average particle diameter of 1.5 μm or smaller was achieved to prepare the dispersions. In addition, 80 g of calcium carbonate was dispersed along with 160 g of 0.5% solution of sodium hexamethacrylate by using a homogenizer to prepare a pigment dispersion (d). The dispersions prepared in the manner described above were mixed in a following formulation to obtain a thermal coating solution.

| | |
|---|---|
| (a) Dye Precursor Dispersion | 5 parts |
| (b) Developer Dispersion | 10 parts |
| (c) Sensitizer Dispersion | 10 parts |
| (d) Calcium Carbonate Dispersion | 5 parts |
| (e) 21% Zinc Stearate Dispersion | 3 parts |

The thermal coating solution was applied to a wood free paper of 50 g/m$^2$ in basic weight by using a wire bar to provide a dry weight of 5 g/m$^2$ of the coated layer, which was dried at 50° C. for 1 minute to produce a thermal recording paper.

EXAMPLES 20–23

Following compounds were used as the dye precursors and the compound A-2 was used as the developer to prepare thermal recording materials in a following manner.

DYE PRECURSORS

CVL: 3,3-bis(p-dimethylaminophenyl)6 -dimethylaminophthalid

ODB-2: 3-N-n-dibutylamino-6-methyl-7 -anilinofluoran

NEW-Blue: 3-(4-diethylamino-2-ethoxyphenyl)-3-(1 -ethyl-2-methylindole-3-yl)-4-azaphthalid I-red: 3,3-bis(1-ethyl-2-methylindole-3-yl)phthalid

DYE PRECURSOR DISPERSION

| | |
|---|---|
| Dye Precursor | 2.0 parts |
| Aqueous Solution of 10%-polyvinyl Alcohol | 4.6 parts |
| Water | 2.6 parts |

Each dispersion of the above mentioned compounds were ground into fine particles having an average particle diameter of 1 micron by using a sand grinder. Subsequently, the dispersions were mixed in a following formulation to prepare a coating solution.

| | |
|---|---|
| Dispersion of Developer using Compound A-2 | 36.0 parts |
| Dispersion of Dye Precursor | 9.2 parts |

-continued

| | |
|---|---|
| Kaolin Clay (50% dispersion) | 12.0 parts |

This solution was coated on one surface of a paper support of 50 g/m$^2$ in a coating amount of 6.0 g/m$^2$, which was then subjected to super-calendering to produce a thermal recording material with a smoothness of 500–600 seconds. The resultant thermal recording materials were evaluated in the same manner as in Examples.

CONTROLS 26 and 27

Examples 20 through 23 were repeated to produce thermal recording sheets except that the developer (compound A-2) used in Examples 20 through 23 were replaced by the compound E-1 or E-2.

Following evaluation tests were performed on the thermal recording materials produced.

RECORDABILITY TEST (Density of Dynamically Developed Color)

A printer of a word processor (RUPO-90F; available from Toshiba Corporation) was used to record images with the maximum applied energy. The recorded images were measured in density by using a Macbeth densitometer (RD-914 with an amber filter; density measurements described below were all obtained under this condition). In this event, the larger a Macbeth value, the thicker the recording density and hence the higher the recording aptitude.

HEAT-RESISTANCE TEST A (With Heat Rolls)

The thermal recording materials were forced to a hot plate, which had previously heated to 200° C., at a pressure of 10 g/cm$^2$ for 5 seconds to cause electrostatic color development. The color-developed thermal recording materials were passed between heat rolls of 160° C. at a speed of 30 mm/s. Subsequently, color-developed and background portions of the materials were measured with the Macbeth densitometer. The smaller a difference in colored density of the recorded portion before and after passing between the heat rolls, the higher the thermal stability. In addition, an extremely low thermal stability of the recorded portion means a high possibility of erasure of the recorded images by using the heat rolls.

HEAT-RESISTANCE TEST B (With Step Edges)

Each of the thermal recording sheets was forced to a hot plate, which had previously heated to 150° C., at a pressure of 8 g/cm$^2$ for 4 seconds, following which the Macbeth density of the color developed portion was measured to examine the thermal stability of the background. The smaller the Macbeth value, the higher the thermal stability of the background.

THERMAL LAMINATING TEST

The thermal recording materials subjected to dynamic color development were interposed between MS pouch films, which were passed between heat rolls of a simple laminating machine (MS Pouch H-140 available from Meiko Shokai Co., Ltd.) at an intermediate speed to thermally laminate the films. The Macbeth densities of the recorded portion and the background were then measured. The smaller a difference in density between the recorded portion and the background before and after the laminating process, the more the material is suitable to be formed into a laminated card.

OIL BASED INK APTITUDE TEST

Characters were written on the thermal recording materials with an oil based red ink No. 500 (manufactured by Teranishi Chemical Industry Co., Ltd.). A degree of change in color was measured visually relative to the original red.

⊙ . . . no color change

○ . . . less color change

Δ . . . slight color change

X . . . remarkable color change

Evaluation results of the above mentioned tests on Examples 1–23 and Controls 1–27 are set forth in Table 1 through Table 4.

TABLE 1

| Entry. | DEVELOPER | ADDITIVE | BACKGROUND COLOR BEFORE RECORDING | RECORDED PORTION ON RECORDABILITY TEST | HEAT RESISTANCE TEST A RECORDED PORTION | HEAT RESISTANCE BACK GROUND |
|---|---|---|---|---|---|---|
| Example 1 | COMPOUND A-1 | NONE | 0.04 | 1.20 | 0.61 | 0.04 |
| Example 2 | COMPOUND A-2 | NONE | 0.04 | 1.35 | 1.34 | 0.07 |
| Example 3 | COMPOUND A-3 | NONE | 0.04 | 1.30 | 1.36 | 0.04 |
| Example 4 | COMPOUND A-4 | NONE | 0.04 | 1.22 | 1.32 | 0.06 |
| Example 5 | COMPOUND A-5 | NONE | 0.03 | 1.00 | 0.89 | 0.09 |
| Example 6 | COMPOUND A-6 | NONE | 0.03 | 1.16 | 0.98 | 0.05 |
| Example 7 | COMPOUND A-7 | NONE | 0.04 | 1.22 | 1.32 | 0.17 |
| Example 8 | COMPOUND A-8 | NONE | 0.05 | 1.25 | 1.19 | 0.06 |
| Example 9 | COMPOUND A-9 | NONE | 0.03 | 1.06 | 0.63 | 0.07 |
| Example 10 | COMPOUND A-10 | NONE | 0.06 | 1.02 | 1.00 | 0.06 |
| Example 11 | COMPOUND B-1 | NONE | 0.03 | 1.31 | 1.32 | 0.09 |
| Example 12 | COMPOUND B-3 | NONE | 0.05 | 1.24 | 1.39 | 0.09 |
| Example 13 | COMPOUND B-8 | NONE | 0.04 | 1.21 | 1.56 | 0.09 |
| Example 14 | COMPOUND B-13 | NONE | 0.04 | 1.13 | 1.43 | 0.08 |
| Example 15 | COMPOUND C-1 | NONE | 0.03 | 1.30 | 1.34 | 0.07 |
| Example 16 | COMPOUND C-4 | NONE | 0.04 | 1.25 | 1.30 | 0.09 |
| Example 17 | COMPOUND D-1 | NONE | 0.05 | 1.31 | 1.68 | 0.09 |
| Example 18 | COMPOUND D-2 | NONE | 0.04 | 1.33 | 1.58 | 0.08 |

TABLE 1-continued

| | | | | | | |
|---|---|---|---|---|---|---|
| Example 19 | COMPOUND D-3 | NONE | 0.06 | 1.19 | 1.20 | 0.09 |

| | HEAT | THERMALL LAMINATING | | |
|---|---|---|---|---|
| Entry. | RESISTANCE TEST B BACKGROUND | TEST RECORDED PORTION | BACK GROUND | OIL BASED INK APITITUDE |
| Example 1 | 0.05 | 1.30 | 0.10 | ◎ |
| Example 2 | 0.04 | 1.70 | 0.10 | ◎ |
| Example 3 | 0.08 | 1.59 | 0.13 | ◎ |
| Example 4 | 0.06 | 1.57 | 0.11 | ◎ |
| Example 5 | 0.09 | 1.32 | 0.11 | ◎ |
| Example 6 | 0.06 | 1.38 | 0.13 | ◎ |
| Example 7 | 0.12 | 1.61 | 0.11 | ◎ |
| Example 8 | 0.08 | 1.63 | 0.12 | ◎ |
| Example 9 | 0.06 | 1.00 | 0.12 | ◎ |
| Example 10 | 0.06 | 1.32 | 0.11 | ◎ |
| Example 11 | 0.11 | 1.78 | 0.12 | ◎ |
| Example 12 | 0.08 | 1.42 | 0.11 | ◎ |
| Example 13 | 0.07 | 1.39 | 0.12 | ◎ |
| Example 14 | 0.07 | 1.20 | 0.11 | ◎ |
| Example 15 | 0.05 | 1.40 | 0.11 | ◎ |
| Example 16 | 0.07 | 1.36 | 0.13 | ◎ |
| Example 17 | 0.05 | 1.38 | 0.12 | ◎ |
| Example 18 | 0.06 | 1.34 | 0.10 | ◎ |
| Example 19 | 0.08 | 1.22 | 0.11 | ◎ |

NOTE:
ODB was used on the dye

TABLE 2

| Entry. | DEVELOPER | ADDITIVE | BACKGROUND COLOR BEFORE RECORDING | RECORDED PORTION ON RECORDABILITY TEST | HEAT RESISTANCE TEST A RECORDED PORTION |
|---|---|---|---|---|---|
| CONTROL 1 | COMPOUND E-1 | NONE | 0.06 | 1.44 | 1.58 |
| CONTROL 2 | COMPOUND E-2 | NONE | 0.06 | 1.30 | 1.43 |
| CONTROL 3 | COMPOUND E-3 | NONE | 0.04 | 1.50 | 1.50 |
| CONTROL 4 | COMPOUND E-4 | NONE | 0.04 | 1.53 | 1.54 |
| CONTROL 5 | COMPOUND E-5 | NONE | 0.02 | 1.50 | 1.19 |
| CONTROL 6 | COMPOUND E-6 | NONE | 0.03 | 1.33 | 1.32 |
| CONTROL 7 | COMPOUND E-7 | NONE | 0.04 | 0.43 | 0.41 |
| CONTROL 8 | COMPOUND E-8 | NONE | 0.05 | 1.45 | 1.49 |
| CONTROL 9 | COMPOUND E-9 | NONE | 0.04 | 0.58 | 0.31 |
| CONTROL 10 | COMPOUND E-10 | NONE | 0.05 | 1.06 | 0.59 |
| CONTROL 11 | COMPOUND E-11 | NONE | 0.03 | 1.35 | 1.31 |
| CONTROL 12 | COMPOUND E-12 | NONE | 0.03 | 1.26 | 1.38 |
| CONTROL 13 | COMPOUND E-13 | NONE | 0.04 | 1.21 | 0.85 |
| CONTROL 14 | COMPOUND E-14 | NONE | 0.04 | 1.35 | 1.31 |
| CONTROL 15 | COMPOUND E-15 | NONE | 0.03 | 1.12 | 1.02 |
| CONTROL 16 | COMPOUND E-16 | NONE | 0.03 | 0.91 | 1.00 |
| CONTROL 17 | COMPOUND E-17 | NONE | 0.03 | 1.13 | 0.33 |

| | HEAT | HEAT | THERMALL LAMINATING | | |
|---|---|---|---|---|---|
| Entry. | RESISTANCE BACK GROUND | RESISTANCE TEST B BACKGROUND | TEST RECORDED PORTION | BACK GROUND | OIL BASED INK APITITUDE |
| CONTROL 1 | 1.50 | 1.53 | 1.96 | 1.96 | X |
| CONTROL 2 | 1.99 | 0.58 | 1.77 | 0.55 | X |
| CONTROL 3 | 1.57 | 1.58 | 1.99 | 1.86 | X |
| CONTROL 4 | 1.49 | 1.53 | 1.17 | 0.28 | X |
| CONTROL 5 | 1.05 | 1.02 | 1.17 | 0.18 | ○ |
| CONTROL 6 | 1.20 | 1.02 | 1.11 | 0.14 | ○ |
| CONTROL 7 | 0.38 | 0.36 | 0.52 | 0.29 | ○ |
| CONTROL 8 | 1.45 | 1.43 | 1.84 | 1.62 | X |
| CONTROL 9 | 0.23 | 0.11 | 0.31 | 0.11 | X |
| CONTROL 10 | 0.05 | 0.05 | 0.62 | 0.11 | ◎ |
| CONTROL 11 | 1.30 | 1.19 | 1.54 | 1.31 | ◎ |
| CONTROL 12 | 1.38 | 1.29 | 1.66 | 0.98 | ◎ |
| CONTROL 13 | 0.35 | 0.31 | 1.03 | 0.38 | ◎ |
| CONTROL 14 | 1.31 | 1.19 | 1.24 | 1.12 | ◎ |
| CONTROL 15 | 1.03 | 1.08 | 1.34 | 1.02 | ◎ |

TABLE 2-continued

| | | | | | |
|---|---|---|---|---|---|
| CONTROL 16 | 0.95 | 0.93 | 1.01 | 0.73 | ○ |
| CONTROL 17 | 0.13 | 0.10 | 0.29 | 0.18 | ○ |

NOTE:
ODB was used on the dye

TABLE 3

| Entry. | DEVELOPER | ADDITIVE | BACKGROUND COLOR BEFORE RECORDING | RECORDED PORTION ON RECORDABILITY TEST |
|---|---|---|---|---|
| CONTROL 18 | SA1-Zn | COMPOUD A-8 + SENSITIZER A | 0.08 | 1.46 |
| CONTROL 19 | SA1-Zn | COMPOUD A-10 + SENSITIZER A | 0.06 | 1.46 |
| CONTROL 20 | SA1-Zn | COMPOUD E-10 + SENSITIZER A | 0.04 | 1.39 |
| CONTROL 21 | SA2-Zn | COMPOUD A-5 + SENSITIZER A | 0.05 | 1.41 |
| CONTROL 22 | SA2-Zn | COMPOUD A-7 + SENSITIZER A | 0.06 | 1.47 |
| CONTROL 23 | SA2-Zn | COMPOUD E-12 + SENSITIZER A | 0.05 | 1.38 |
| CONTROL 24 | | COMPOUND A-5 SENSITIZER A | 0.05 | 1.43 |
| CONTROL 25 | | COMPOUND A-6 SENSITIZER A | 0.04 | 1.15 |

| | HEAT RESISTANCE | | HEAT | THERMALL LAMINATING | | |
|---|---|---|---|---|---|---|
| | TEST A RECORDED PORTION | BACK GROUND | RESISTANCE TEST B BACKGROUND | TEST RECORDED PORTION | BACK GROUND | OIL BASED INK APTITUDE |
| CONTROL 18 | 1.48 | 1.45 | 1.45 | 1.75 | 1.56 | X |
| CONTROL 19 | 1.47 | 1.36 | 1.46 | 1.65 | 1.53 | X |
| CONTROL 20 | 1.42 | 1.33 | 1.45 | 1.44 | 1.50 | X |
| CONTROL 21 | 1.42 | 1.36 | 1.40 | 1.72 | 1.63 | ○ |
| CONTROL 22 | 1.46 | 1.40 | 1.46 | 1.77 | 1.65 | X |
| CONTROL 23 | 1.36 | 1.35 | 1.34 | 1.42 | 1.40 | ○ |
| CONTROL 24 | 1.44 | 1.26 | 1.10 | 1.41 | 1.09 | ◎ |
| CONTROL 25 | 1.32 | 1.03 | 1.01 | 1.31 | 1.04 | ○ |

NOTE:
ODB was used on the dye
SA1-Zn = 4-ρ-methoxyphenoxyethoxy zinc salicylate
SA2-Zn = 3,5-bis(methyl pentyl) zinc salicylate
SENSITIZER A = di(ρ-methyl benzyl) oxalate ester

TABLE 4

| Entry. | DEVELOPER | DYE | BACKGROUND COLOR BEFORE RECORDING | RECORDED PORTION ON RECORDABILITY TEST | HEAT RESISTANCE TEST A RECORDED PORTION | HEAT RESISTANCE BACK GROUND |
|---|---|---|---|---|---|---|
| Example 20 | COMPOUND A-2 | CVL | 0.03 | 0.82 | 0.75 | 0.04 |
| Example 21 | COMPOUND A-2 | ODB-2 | 0.04 | 1.36 | 1.04 | 0.04 |
| Example 22 | COMPOUND A-2 | NEW-Blue | 0.04 | 0.98 | 0.98 | 0.07 |
| Example 23 | COMPOUND A-2 | I-red | 0.02 | 0.82 | 0.80 | 0.03 |
| CONTROL 26 | COMPOUND E-1 | ODB-2 | 0.06 | 1.30 | 1.35 | 1.34 |
| CONTROL 27 | COMPOUND E-2 | NEW-Blue | 0.05 | 1.34 | 1.36 | 1.37 |

| | HEAT | THERMAL LAMINATING | | |
|---|---|---|---|---|
| | RESISTANCE TEST B BACKGROUND | TEST RECORDED PORTION | BACK GROUND | OIL BASED INK APTITUDE |
| Example 20 | 0.03 | 0.81 | 0.09 | ◎ |
| Example 21 | 0.05 | 1.18 | 0.10 | ◎ |
| Example 22 | 0.08 | 1.15 | 0.10 | ◎ |
| Example 23 | 0.02 | 0.91 | 0.09 | ◎ |
| CONTROL 26 | 1.24 | 1.56 | 1.45 | X |
| CONTROL 27 | 1.34 | 1.58 | 1.47 | X |

NOTE:
NO additive used

The thermal recording materials produced were subjected to a following reversible recordability test.

REVERSIBLE RECORDABILITY TEST (Discoloration Test with Ethanol)

The thermal recording materials with recorded images developed with a printer of a word processor were immersed in ethyl alcohol for 2 seconds, following which the Macbeth densities of the recorded portion and the background were measured. After being dried, the thermal recording materials were again subjected to recording with the word processor, following which the Macbeth densities of the recorded portion and the background were again measured. The smaller the Macbeth value of the recorded portion after being processed with ethyl alcohol and the larger the Macbeth value of the same portion after re-recording, the higher the reversible recordability of the thermal recording material. Evaluation results are set forth in Table 5.

suitable for use as the PPC paper.

As apparent from Table 1 through Table 4, in the thermal recording materials comprising the bisthiourea compound according to the present invention as the developer and comprising no sensitizer, the background is substantially unchanged at a temperature of from 120° to 150° C. With a thermal head, however, images having the desired density can be obtained. Accordingly, effects of the present invention are as follows:

(1) thermal recording materials become available under a high temperature conditions ranging from 100° to 150° C., which was not suitable for conventional thermal recording;

(2) a card having a thermal recorded portion can be readily made since it is possible to laminate a film thermally on the recorded surface after thermal recording;

(3) the materials are applicable in various electrophotographic copying machines;

TABLE 5

| Entry. | DEVELOPER | ADDITIVE | DYE | BACKGROUND COLOR BEFORE RECORDING | REVERSIBLE RECORDABILITY TEST RECORD - ERASURE |
|---|---|---|---|---|---|
| Example 1 | COMPOUND A-1 | NONE | ODB | 0.04 | 1.20 |
| Example 2 | COMPOUND A-2 | NONE | ODB | 0.04 | 1.35 |
| Example 4 | COMPOUND A-4 | NONE | ODB | 0.04 | 1.22 |
| Example 10 | COMPOUND A-10 | NONE | ODB | 0.06 | 1.02 |
| Example 17 | COMPOUND D-1 | NONE | ODB | 0.05 | 1.31 |
| Example 20 | COMPOUND A-2 | NONE | CVL | 0.03 | 0.82 |
| Example 21 | COMPOUND A-2 | NONE | ODB-2 | 0.04 | 1.36 |
| Example 22 | COMPOUND A-2 | NONE | NEW-Blue | 0.04 | 0.98 |
| Example 23 | COMPOUND A-2 | NONE | I-red | 0.02 | 0.82 |
| CONTROL 1 | COMPOUND E-1 | NONE | ODB | 0.06 | 1.44 |
| CONTROL 2 | COMPOUND 6-2 | NONE | ODB | 0.06 | 1.30 |
| CONTROL 10 | COMPOUND E-12 | NONE | ODB | 0.03 | 1.36 |
| CONTROL 17 | SA1-Zn | COMPOUND A-8/SENSITIZER A | ODB | 0.06 | 1.46 |
| CONTROL 22 | COMPOUND A-5 | SENSITIZER A | ODB | 0.05 | 1.45 |

| Entry. | ( RECORDED PORTION | BACK GROUND ) | - RE-RECORDING |
|---|---|---|---|
| Example 1 | 0.10 | 0.04 | 1.14 |
| Example 2 | 0.09 | 0.04 | 1.21 |
| Example 4 | 0.11 | 0.05 | 1.16 |
| Example 10 | 0.20 | 0.05 | 0.95 |
| Example 17 | 0.10 | 0.05 | 1.18 |
| Example 20 | 0.08 | 0.05 | 0.75 |
| Example 21 | 0.12 | 0.05 | 1.29 |
| Example 22 | 0.12 | 0.05 | 0.90 |
| Example 23 | 0.11 | 0.04 | 0.75 |
| CONTROL 1 | — | 1.35 | — |
| CONTROL 2 | — | 1.29 | — |
| CONTROL 10 | 0.86 | 0.41 | — |
| CONTROL 17 | — | 1.37 | — |
| CONTROL 22 | 1.03 | 0.13 | — |

NOTE:
SA1-Zn = 4-ρ-methoxyphenoxyethoxy zinc salicylate
SENSITIZER A = di(ρ-methyl benzyl) oxalate ester

EXAMPLE 24

The thermal recording material produced in Example 1 was subjected to recording with toner by using a copier (NP6060 available from Canon Inc.). As a result, clear images were obtained without causing color development of the background. On the contrary, with the thermal recording material produced in Control 1 used as the PPC paper, the background of the thermal color developing layer on the recording sheet was developed its color and thus was not (4) the materials cannot be affected by oil based inks, so that any images can be written thereon with these inks; and (5) advanced recording system is achieved in which color recording and erasure can be made repeatedly, which permits recycled use of the thermal recording materials, saving resources. Unlike liquid crystals, the present materials can be used as a simple way of indication for recording and erasing using energies in different levels.

What is claimed is:

1. A thermal recording material which is heat stable at temperatures above 100° C. comprising a support coated with a coating solution as a color developing layer, wherein the color developing layer comprises a colorless dye precursor which is normally colorless or light-colored, and a developer which reacts with the dye precursor to cause color development thereof upon heating, and which layer does not contain a sensitizer for the dye precursor or for the developer, and wherein the developer is a bisthiourea compound represented by one of formulae (A-1) through (A-10):

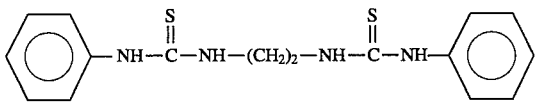

(A-1)

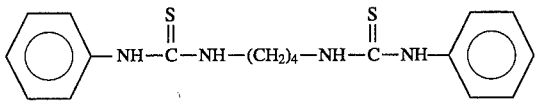

(A-2)

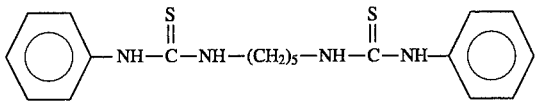

(A-3)

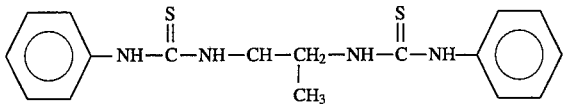

(A-4)

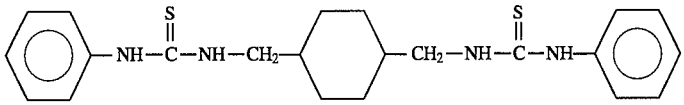

(A-5)

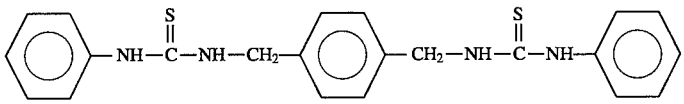

(A-6)

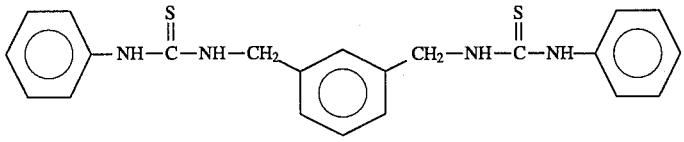

(A-7)

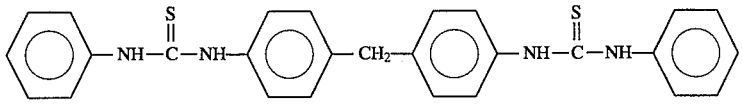

(A-8)

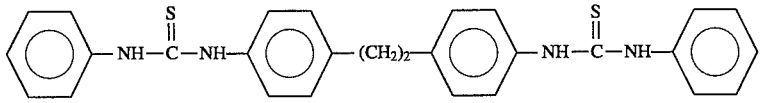

(A-9)

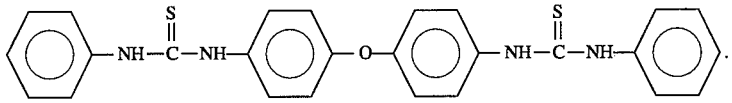

(A-10)

2. A material as claimed in claim 1, wherein the dye precursor is 3-N,N-diethylamino-6-methyl-7-anilinofluoran.

3. A thermal recorded material comprising a thermal recording material according to claim 1, the material being subjected to recording to provide a recorded portion on one surface thereof, the surface being covered with a plastic film.

4. A material as claimed in claim 3, wherein the plastic film is laminated on the surface through thermal laminating.

5. The thermal recording material of claim 1 which is heat stable at temperatures of 120° C. to 160° C.

6. The thermal recording material of claim 1 which is heat stable at temperatures of 150° C. to 160° C.

7. The thermal recording material of claim 1 wherein the difference in Macbeth background value before and after exposure to heat at a temperature above 100° C. is 0.13 or less.

8. The thermal recording material of claim 1 wherein the difference in Macbeth background value before and after exposure to heat at a temperature of 150° C. to 160° C. is 0.13 or less.

9. The thermal recording material of claim 1 including a thermally applied protective laminate film.

10. A method for reversibly recording a thermal recording material comprising a support coated with a coating solution as a color developing layer, wherein the color developing layer comprises a colorless dye precursor which is normally colorless or light-colored, and a developer which reacts with the dye precursor to cause color development thereof upon heating and thereby to provide a recorded portion on the material, which method comprises the steps of thermally recording an image on the developing layer and erasing the recorded image by contacting the developing layer with an alcohol solvent and wherein the developer is a bisthiourea compound represented by one of formulae (A-1), (A-2), (A-4) and (A-10):

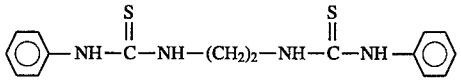

(A-1)

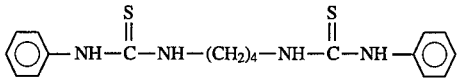

(A-2)

-continued

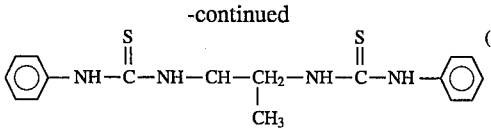

(A-4)

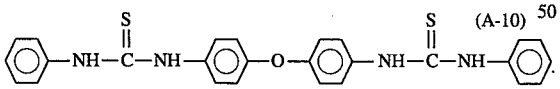

(A-10)

11. The method of claim 10 wherein the erased recording material is again used to thermally record an image.

12. The method of claim 10, wherein the dye precursor is 3-N,N-diethylamino-6-methyl-7-anilinofluoran.

13. The method of claim 10, wherein the recorded portion is erased with an alcoholic solvent containing one to four carbon atoms without affecting perservability and stability of a background.

14. A thermal recording material comprising a support coated with a coating solution as a color developing layer, wherein the color developing layer comprises a colorless dye precursor which is normally colorless or light-colored, and a developer which reacts with the dye precursor to cause color development thereof upon heating, the developer being at least one bisthiourea compound represented by the following general formula (I):

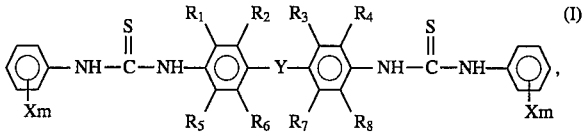

(I)

wherein X, $R_1$, $R_2$, $R_3$, $R_4$, $R_5$, $R_6$, $R_7$, and $R_8$ are each a lower alkyl group having from 1 to 6 carbon atoms, an alkoxy group having from 1 to 6 carbon atoms, a cyclohexyl group, a nitro group, a cyano group, a halogen atom or a hydrogen atom; Y is S or $SO_2$; and m is an integer of from 1 to 3.

15. A material as claimed in claim 14, wherein the compound represented by the general formula (I) is at least one selected from the group consisting of B-1, B-8, and C-1

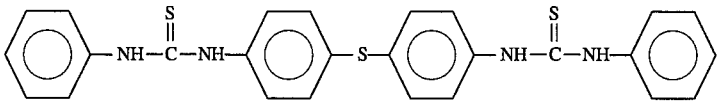

(B-1)

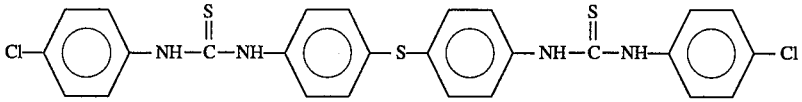

(B-2)

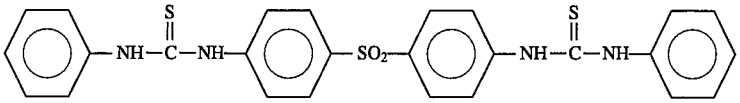

(C-1)

16. A material as claimed in claim 15, wherein the compound represented by the general formula (I) is a compound of B-1

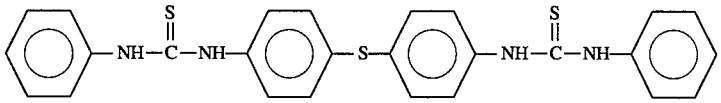

(B-1)

17. A material as claimed in claim 15, wherein the compound represented by the general formula (I) is a compound of B-8.

18. A material as claimed in claim 15, wherein the compound represented by the general formula (I) is a compound of C-1.

19. A material as claimed in claim 14, wherein the dye precursor is 3-N,N-diethylamino-6-methyl-7-anilinofluoran.

20. A thermal recording material which is heat stable at temperatures above 100° C. comprising a support coated with a coating solution as a color developing layer, wherein the color developing layer comprises a colorless dye precursor which is normally colorless or light-colored, and a developer which reacts with the dye precursor to cause color development thereof upon heating, and which layer does not contain a sensitizer for the dye precursor or for the developer and wherein the developer is at least one bisthiourea compound represented by the following general formula (I):

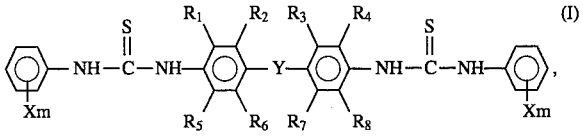

(I)

wherein X, $R_1$, $R_2$, $R_3$, $R_4$, $R_5$, $R_6$, $R_7$, and $R_8$ are each a lower alkyl group having from 1 to 6 carbon atoms, an alkoxy group having from 1 to 6 carbon atoms, a cyclohexyl group, a nitro group, a cyano group, a halogen atom or a hydrogen atom; Y is S or $SO_2$; and m is an integer of from 1 to 3.

21. The thermal recording material of claim 20 which is heat stable at temperatures of 150° C. to 160° C.

22. The thermal recording material of claim 20 wherein the difference in Macbeth background value before and after exposure to heat at a temperature of 150° C. to 160° C. is 0.13 or less.

23. A thermal recording material which is heat stable at temperatures above 100° C. comprising a support coated with a coating solution as a color developing layer, wherein the color developing layer comprises a colorless dye precursor which is normally colorless or light-colored, and a developer which reacts with the dye precursor to cause color development thereof upon heating, and which does not contain a sensitizer for the dye precursor or for the developer and wherein the developer is at least one bisthiourea compound represented by the following general formula (II):

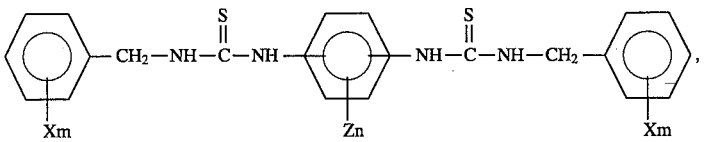

(II)

wherein X and Z are each a lower alkyl group having from 1 to 6 carbon atoms, an alkoxy group having from 1 to 6 carbon atoms, a cyclohexyl group, a nitro group, a cyano group, a halogen atom or a hydrogen atom; and m and n are each an integer of from 1 to 3.

24. The thermal recording material of claim 23 which is heat stable at temperatures of 150° C. to 160° C.

25. The thermal recording material of claim 23 wherein the difference in Macbeth background value before and after exposure to heat at a temperature of 150° C. to 160° C. is 0.13 or less.

26. A material as claimed in claim 23, wherein the compound represented by the general formula (II) is at least one selected from the group consisting of D-1 and D2

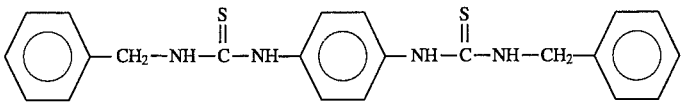

(D-1)

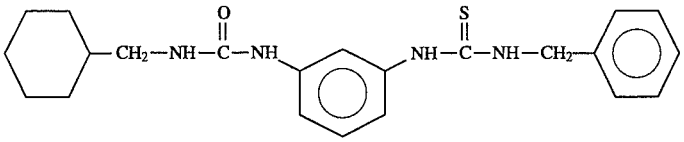

(D-2)

27. A material as claimed in claim 23, wherein the dye precursor is 3-N,N-diethylamino-6-methyl-7-anilinofluoran.

28. A thermal recorded material comprising a thermal recording material according to claim 14 or 23, the material being subjected to recording to provide a recorded portion on one surface thereof, the surface being covered with a plastic film.

29. A material as claimed in claim 28, wherein the plastic film is laminated on the surface through thermal laminating.

* * * * *